US009695380B2

(12) United States Patent
Greaves

(10) Patent No.: US 9,695,380 B2
(45) Date of Patent: Jul. 4, 2017

(54) WATER-GLYCOL HYDRAULIC FLUID COMPOSITIONS

(75) Inventor: Martin R. Greaves, Hirzel (CH)

(73) Assignee: Dow Global Technologies LLC, Midland, MI (US)

( * ) Notice: Subject to any disclaimer, the term of this patent is extended or adjusted under 35 U.S.C. 154(b) by 350 days.

(21) Appl. No.: 12/668,902

(22) PCT Filed: Jul. 2, 2008

(86) PCT No.: PCT/US2008/068957

§ 371 (c)(1),
(2), (4) Date: Jan. 13, 2010

(87) PCT Pub. No.: WO2009/012058

PCT Pub. Date: Jan. 22, 2009

(65) Prior Publication Data

US 2010/0197539 A1 Aug. 5, 2010

Related U.S. Application Data

(60) Provisional application No. 60/961,007, filed on Jul. 18, 2007.

(51) Int. Cl.
*C10M 173/02* (2006.01)

(52) U.S. Cl.
CPC .... *C10M 173/02* (2013.01); *C10M 2207/022* (2013.01); *C10M 2207/046* (2013.01); *C10M 2207/123* (2013.01); *C10M 2207/126* (2013.01); *C10M 2207/127* (2013.01); *C10M 2209/104* (2013.01); *C10M 2209/105* (2013.01); *C10M 2209/107* (2013.01); *C10M 2215/04* (2013.01); *C10M 2215/042* (2013.01); *C10M 2215/223* (2013.01); *C10N 2230/02* (2013.01); *C10N 2230/06* (2013.01); *C10N 2230/12* (2013.01); *C10N 2240/08* (2013.01)

(58) Field of Classification Search
CPC ..... C10M 173/02; C10M 2215/223; C10M 2207/126; C10M 2207/046; C10M 2207/127; C10M 2209/105; C10M 2209/104; C10M 2207/022; C10M 2207/123; C10M 2215/04; C10M 2215/042; C10M 2209/107; C10N 2240/08; C10N 2230/12; C10N 2230/02; C10N 2230/06
USPC ..... 508/459, 511, 530, 579
See application file for complete search history.

(56) References Cited

U.S. PATENT DOCUMENTS

| | | | | |
|---|---|---|---|---|
| 2,558,030 A | | 6/1951 | Zisman et al. | |
| 4,390,439 A | | 6/1983 | Schwartz et al. | |
| 4,390,440 A | * | 6/1983 | Schwartz et al. | 252/76 |
| 4,434,066 A | * | 2/1984 | Lewis | 252/77 |
| 4,493,780 A | | 1/1985 | Schwartz et al. | |
| 4,588,511 A | * | 5/1986 | Frentrup et al. | 508/223 |
| 4,797,229 A | * | 1/1989 | Frentrup et al. | 508/165 |
| 4,855,070 A | | 8/1989 | Lewis | |
| 5,773,393 A | | 6/1998 | Adams | |

FOREIGN PATENT DOCUMENTS

| | | |
|---|---|---|
| DE | 265528 | 3/1989 |
| EP | 0273460 | 7/1988 |
| GB | 2048262 | 12/1980 |

OTHER PUBLICATIONS

International Search Report (PCT/US2008/068957).
Totten, George E. et al., Water-Glycol Hydraulic Fluids, Handbook of Hydraulic Fluid Tecchnology, 2000, pp. 917-982, Chapter 18.
Matlock, Paul L., et al., Polyalkylene Glycols, Synthetic Lubricants & High Performance Functional Fluids, 1993, pp. 101-123, Chapter 4.
Verwendungsbeschraenkungen fuer wassermischbare, 2002, pp. 1-15.
E.W. Flick, Corrosion Inhibitors, An Industrial Guide, 2nd Edition, 1993, Noyes Publications.
Chinese Third Office Action dated Dec. 13, 2013; from Chinese counterpart Application No. 200890107577.5.
Instructions to Chinese Third Office Action dated Jan. 16, 2014; from Chinese counterpart Application No. 200890107577.5.
Chinese Response to Third Office Action dated Jan. 20, 2014; from Chinese counterpart Application No. 200890107577.5.

* cited by examiner

*Primary Examiner* — Taiwo Oladapo
(74) *Attorney, Agent, or Firm* — Brooks, Cameron & Huebsch, PLLC

(57) ABSTRACT

A morpholine-free water-hydraulic liquid composition includes water, a glycol, a polyglycol such as a polyalkylene glycol, an aliphatic carboxylic acid that contains from six to 14 carbon atoms, and a combination of amines and alkanolamines.

5 Claims, No Drawings

WATER-GLYCOL HYDRAULIC FLUID COMPOSITIONS

This invention relates generally to water-glycol hydraulic fluid compositions and more particularly to such compositions that are substantially morpholine-free.

U.S. Pat. No. 4,855,070 to Lewis discloses a water-glycol energy transmitting fluid that comprises a) from 30 percent by weight (wt %) to 40 wt % water, b) diethylene glycol, c) from 0.8 wt % to 5.0 wt % of an aliphatic carboxylic acid having 9 to 12 carbon atoms ($C_9$-$C_{12}$) inclusive, d) a water-soluble polymeric viscosity control agent, e) a corrosion inhibiting amount of at least one corrosion inhibitor, and f) a metal deactivator, each wt % being based upon total fluid weight. Illustrative corrosion inhibitors include alkyl amines such as propylamine and dimethylaminopropylamine; alkanolamines such as monoethanolamine, N,N-dimethylethanolamine or an arylamine such as aminotoluene; another amine-type corrosion inhibitor such as ethylenediamine, morpholine or pyridine; or mixtures thereof. The metal deactivator functions as a chelating agent for copper and copper alloys. Illustrative water-soluble polymeric viscosity control agents include poly(alkylene oxide) polymers, alkylene oxide adducts of alkyl phenols, polyalkyl methacrylates, urethane polymers, polyamide esters, and polyamide alkoxylates, with poly(alkylene oxide) polymers being preferred.

Modern water/glycol hydraulic fluids constitute highly engineered products and comprise a complex mixture of components. Key components of such fluids, in addition to water and glycol, include a high molecular weight (e.g., a number average molecular weight of more than 6,000) polyglycol (also known as an "alkylene glycol") as a thickener or water-soluble polymeric viscosity control agent, vapor phase corrosion inhibitors and solution corrosion inhibitors. Such fluids often contain one or more additives including an anti-wear additive that forms a surface film between moving metal parts in an apparatus such as a pump, especially during start-up activities for the pump. Vapor phase corrosion inhibitors typically provide a measure of protection for ferrous surfaces, such as steel and cast iron, both commonly found in alloys used to fabricate hydraulic equipment. Solution corrosion inhibitors inhibit corrosion of metals often used in hydraulic circuits including cast iron, stainless steel, aluminum, brass and copper. Hydraulic fluids that come in contact with a yellow metal, such as brass, typically contain an additive such as tolyltriazole for yellow metal passivation.

Water/glycol hydraulic fluids find use in automotive, steel and mining industrial applications that typically require reliable, preferably sustained, performance in operation of hydraulic equipment as well as a measure of fire resistance. Fire resistance takes on increasing importance in an environment where there is a significant risk of fire due to fluid leakage. Resistance to fire does not, however, mean complete freedom from fire as skilled artisans recognize that organic fluids, such as glycols, do burn when present in sufficient concentration and exposed to sufficient oxygen, heat and a flame source to ignite at least volatile components of such organic fluids.

A number of regional standards for fire resistance ratings of hydraulic fluids exist. For example, in North America, Factory Mutual certifies fluids according to fire resistance ratings in which the fluids are given a rating of "Product Specified" or "Product Approved", with top tier fluids being certified with a "Product Approved" rating. In Europe, current legal requirements mandate sale of fire resistant fluids that have $7^{th}$ Luxembourg accreditation, a combination of fire resistance and hydraulic wear performance. The latter standard appears to be gaining ground as a global norm for fire resistance ratings.

A general purpose water/glycol hydraulic fluid (sometimes referred to as a "hydrolube") marketed by The Dow Chemical Company under the trade designation UCON™ Hydrolube DG-746 finds use in vane, gear and piston pump hydraulic equipment, all of which operate at a outlet pressure of up to 3500 pounds per square inch gauge (psig) (24 megapascals (MPa). Higher outlet pressures typically use an alternate hydrolube such as UCON™ Hydrolube HP-5046 which is recommended for hydraulic pumps operating at pressures up to 5000 psig (34 MPa). These hydrolubes are among many marketed by producers of hydrolubes that contain morpholine.

As industrial demands increase, particularly for hydraulic equipment that both has a size smaller than current hydraulic equipment and operates under a pressure in excess of 5000 psig (30 MPa), hydraulic equipment under construction or development, tends to have a smaller fluid reservoir size than hydraulic equipment in use in the 1990's or even early 2000's. A smaller fluid reservoir translates, in turn, to an increased number of times that a hydraulic fluid circulates around a hydraulic circuit within such equipment, thereby effectively exposing such fluid to a higher stress environment than that present in earlier hydraulic equipment. The higher stress environment usually includes higher bulk fluid temperatures than those experienced in such earlier hydraulic equipment. The higher stress environment can lead to one or more of viscosity loss, possibly because of shear instability at the higher pressures, degradation of the hydraulic fluid sufficient to produce degradation products such as thermo-oxidative degradation products that increase hydraulic equipment component wear rates relative to hydraulic fluids that lack such degradation products. Totten and Sun, in *Handbook of Hydraulic Fluid Technology*, (2000) note, at page 917, that degradation products such as formic acid have been shown to significantly increase hydraulic wear rates in water glycol hydraulic fluids at levels in excess of 0.15 percent by weight (wt %), based upon total weight of fluid. Smaller hydraulic equipment leads, in turn, to a requirement for hydraulic fluids that withstand operating in such a higher stress environment.

Legislation in certain countries, primarily those located in Europe, designates secondary amines, such as morpholine, as restricted materials because of a potential to form nitrosamines when in contact with sodium nitrite, a commonly used corrosion inhibitor in fluid and lubricant formulations. As such, compounds that contain morpholine (e.g. morpholine-containing fire resistant water/glycol hydraulic fluids) also fall in a class of restricted materials. Elimination of morpholine from fire resistant water/glycol hydraulic fluids should take such fluids out of the class of restricted materials.

An aspect of an invention embodied in appended claims is a substantially morpholine-free water-hydraulic liquid composition, the liquid composition comprising water, a glycol, a polyglycol, an aliphatic carboxylic acid that contains from six to 14 carbon atoms, and a combination of amines and alkanolamines.

Compositions of the present invention include a combination of amines and alkanolamines. The amine is preferably selected from a group consisting of 2-amino-2-methyl-1-propanol (AMP), mono-isopropanolamine (MIPA), monoethanolamine (MEA), 2-amino-1,3-propanediol, 2-amino-2-methyl-1,3-propanediol, 2-amino-2-ethyl-1,3-propanediol, tris(hydroxymethyl)-aminomethane and 2-amino-butanol, and is more preferably 2-amino-2-methyl-1-propanol.

The alkanol amine, also known as a "tertiary amine" is selected from a group consisting of methyldiethanolamine (MDEA), N,N-Dimethylethanolamine (DMEA), N,N-Diethylethanolamine (DEEA), triethanolamine (TEA) and 2-dimethylamino-2-methyl-1-propanol (DMAMP). The combination preferably comprises a mixture of 2-amino-2-methyl-1-propanol with one or both of DMEA and DEEA.

Compositions of the present invention have a primary amine content that lies within a range of from 0.1 to 2 percent by weight (wt %), preferably within a range of from 0.5 wt % to 1 wt %, more preferably within a range of from 0.6 wt % to 0.7 wt %, in each case based upon total composition weight.

Compositions of the present invention have a tertiary amine or alkanolamine content that lies within a range of from 0.1 to 2.0 percent by weight (wt %), preferably within a range of from 0.5 wt % to 1.0 wt %, more preferably within a range of from 0.5 wt % to 0.7 wt %, in each case based upon total composition weight.

Compositions of the present invention include an amount of polyglycol or alkylene glycol. The amount preferably lies within a range of from 30 percent by weight to 50 percent by weight, based upon total composition weight.

Illustrative alkylene glycols include those selected from a group consisting of ethylene glycol, propylene glycol, diethylene glycol, triethylene glycol, dipropylene glycol, tripropylene glycol, a "bottom glycols" fraction produced during manufacture of diethylene glycol, and butylene glycol.

The alkylene glycol is preferably a polyalkylene glycol selected from a group consisting of random copolymers of ethylene oxide and propylene oxide, more preferably a random copolymer of ethylene oxide and propylene oxide with an ethylene oxide content within a range of from 50 wt % to 90 wt % and a complementary propylene oxide content within a range of from 10 wt % to 50 wt %, in each case based upon total weight of ethylene oxide and propylene oxide, with complementary amount of propylene oxide, when added to amount of ethylene oxide, equaling 100 percent by weight. The random copolymer of ethylene oxide and propylene oxide more preferably has an ethylene oxide content within a range of from 70 wt % to 80 wt %, with a complementary propylene oxide content within a range of from 20 wt % to 30 wt %. The random copolymer of ethylene oxide and propylene oxide still more preferably has an ethylene oxide content within a range of from about 74 wt % to 76 wt %, with complementary propylene oxide content within a range of from 26 wt % to 24 wt %. The random copolymer of ethylene oxide and propylene most preferably has an ethylene oxide content of about 75 wt % and a complementary propylene oxide content of about 25 wt %.

The polyglycols used in water-liquid compositions of the present invention function as a viscosity modifier or thickening agent and have a number average molecular weight that is preferably within a range of from 6,000 to 40,000, more preferably within a range of from 8,000 to 30,000, and still more preferably within a range of from about 10,000 to 25,000. Skilled artisans understand that a viscosity modifier increases composition viscosity, or thickens it, relative to an identical composition save for absence of the viscosity modifier. Without a viscosity modifier, composition viscosity of a water-glycol hydraulic fluid may be low enough to lead to problems such as excess apparatus (e.g. pump) wear or fluid leakage through or past apparatus seals.

In preparing such polyglycols, react a random mixed feed of ethylene oxide and propylene oxide onto an initiator such as glycerol, pentaerythritol, trimethylolpropane or diethylene glycol. Paul Matlock and William R. Brown describe such preparation in a chapter devoted to polyalkylene glycols in *Synthetic Lubricants & High Performance Functional Fluids*, (1993), chapter 4, p. 101-123, edited by Ronald Shubkin.

Substantially morpholine-free water-hydraulic liquid compositions of the present invention include water to promote fire resistance, diethylene glycol for low temperature control, a short chain (six to fourteen carbon atoms ($C_6$ to $C_{14}$)) aliphatic carboxylic acid such as decanoic acid (sometimes referred to as "capric acid") or nonanoic acid (sometimes known as perlagonic acid) as an anti-wear component for pump start and boundary lubrication, tolyltriazole for yellow metal passivation and polyalkylene glycol as a high molecular weight viscosity modifier for hydrodynamic lubrication.

The aliphatic carboxylic acid is preferably at least one of a mono-carboxylic acid selected from a group consisting of neo-octanoic acid, 2-ethylhexanoic acid, nonanoic acid, iso-nonanoic acid, decanoic acid, neo-decanoic acid, undecanoic acid, lauric and tetradecanoic acid or a dicarboxylic acid selected from 1,8-octane dicarboxylic acid, 1,7-heptane dicarboxylic acid and dodecanedioic acid. The aliphatic carboxylic acid is more preferably decanoic acid.

The aliphatic carboxylic acid is present in an amount sufficient to form an equilibrium acid-base salt complex with at least one amine. By way of illustration, when the aliphatic carboxylic acid is decanoic acid, the amount is preferably within a range of from 0.5 percent by weight (wt %) to 2.5 wt %, based upon total water-hydraulic liquid composition weight.

Liquid compositions of the present invention have a basic pH, preferably a pH within a range of from 8 to 11, more preferably from about 9 to about 10. Within the range of from about 9 to about 10, the pH is preferably from 9.0 to 10.0, more preferably from 9.2 to 9.9, still more preferably from 9.2 to 9.8, and even more preferably from 9.2 to 9.6. The compositions also have an initial reserve alkalinity within a range of from about 145 milliliters (ml) to about 200 ml, preferably from 150 ml to less than or equal to 190 ml, more preferably from greater than or equal to 160 ml to less than or equal to 190 ml. Skilled artisans understand that a pH in excess of 10 and an initial reserve alkalinity value in excess of 200 ml can each lead to severe staining of aluminum, especially if the pH exceeds 10 and the initial reserve alkalinity value exceeds 200 ml. Conversely, an initial reserve alkalinity less than 150 ml and/or a pH less than 9 can result in corrosion problems for ferrous metals.

By way of illustration, but not by limitation, preparation of substantially morpholine-free, preferably completely morpholine-free, water-hydraulic liquid compositions of the present invention suitably involves mixing or stirring together a combination of water, glycol (e.g. diethylene glycol), primary amine and tertiary amine (also referred to herein as "alkanolamine") at, for example, ambient temperature (nominally 25° C.). Stirring at this temperature preferably continues until the combination appears as a visually clear, homogeneous solution. Add the aliphatic carboxylic acid with continued stirring, preferably until the solution once again appears as a visually clear, homogeneous solution. If one chooses to add a yellow metal passivator such as tolyl triazole, add it next with stirring to facilitate dissolution of the yellow metal passivator. Mild (up to 50° C.) heating may enhance dissolution of the yellow metal passivator.

Following dissolution of the yellow metal passivator, or following addition of the aliphatic carboxylic acid if one omits a yellow metal passivator, add a polyglycol or polymeric thickening agent with continued stirring until the solution once again takes on appearance as a visually clear, homogeneous solution.

The illustrative preparation of water-hydraulic liquid compositions of the present invention employs "mild" temperatures of no more than 50° C. While higher temperatures may be used if desired, such higher temperatures need not be employed. One should, however, avoid temperatures in excess of 160° C. to substantially preclude formation of amides. Amides are neither needed nor desired in compositions of the present invention.

The substantially morpholine-free water-hydraulic liquid compositions of the present invention preferably yield a total weight loss of ring and vanes in a Vickers Vane V104C pump test of less than 100 milligrams as measured in accord with ASTM D7043 as described below. The total weight loss is preferably less than 50 milligrams.

The substantially morpholine-free water-hydraulic liquid compositions of the present invention have a water content that is greater than 0 wt %, preferably greater than 40 wt %, more preferably more than 44 wt %, in each case based upon total composition weight. The amount of water is preferably less than that which leads to a total ring and vane weight loss more than 100 milligrams, more preferably but no more than 54% by weight, based upon total composition weight.

As used herein, "initial reserve alkalinity" or "initial RA" refers to reserve alkalinity of a liquid composition of the present invention before use. Skilled artisans recognize that, during use of such liquid compositions, concentration of vapor phase corrosion inhibitor tends to decrease which, in turn, typically leads to a decrease in reserve alkalinity. Skilled artisans also recognize that degradation of organic components of liquid compositions of the present invention promotes formation of degradation products (e.g. formic acid) that also lead to a drop in reserve alkalinity (e.g. a decrease from 160 ml to 150 ml or even lower).

As used herein, "final reserve alkalinity" or "final RA" refers to reserve alkalinity (RA) of a liquid composition of the present invention upon completion of wear testing for such a composition as described in more detail below in a section entitled "Examples". One also determines final pH and final KV40 following completion of such testing.

When ranges are stated herein, as in a range of from 2 to 10, both end points of the range (e.g. 2 and 10) and each numerical value, whether such value is a rational number or an irrational number, are included within the range unless otherwise specifically excluded.

References to the Periodic Table of the Elements herein shall refer to the Periodic Table of the Elements, published and copyrighted by CRC Press, Inc., 2003. Also, any references to a Group or Groups shall be to the Group or Groups reflected in this Periodic Table of the Elements using the IUPAC system for numbering groups.

Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference) especially with respect to the disclosure of synthetic techniques, definitions (to the extent not inconsistent with any definitions provided herein) and general knowledge in the art.

The term "comprising" and derivatives thereof does not exclude the presence of any additional component, step or procedure, whether or not the same is disclosed herein. In order to avoid any doubt, all compositions claimed herein through use of the term "comprising" may include any additional additive, adjuvant, or compound whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed. The term "or", unless stated otherwise, refers to the listed members individually as well as in any combination.

Expressions of temperature may be in terms either of degrees Fahrenheit (° F.) together with its equivalent in ° C. or, more typically, simply in ° C.

Corrosion Performance Testing

Measure corrosion performance of a water/glycol hydraulic solution, both solution phase and vapour phase, using a modification of American Standard for Testing and Materials (ASTM) G31-72. Immerse steel, cast iron, copper, brass and aluminium coupons in the hydraulic fluid, the fluid being contained in a Pyrex vessel (approximately 50 centimeters (cm) in length by 8 cm in diameter) fitted with air inlet and outlet ports. In addition, suspend cast iron and steel coupons above the fluid level to assess vapor phase corrosion. Heat the hydraulic fluid to a set point temperature of 70° C. and maintain the fluid at that for 200 hours while blowing air through the fluid at a rate of 100 milliliters per minute (ml/min). After each 24 hour period that the fluid is at 70° C., top the fluid off with de-ionised water to replace any evaporated fluid.

Upon completion of the 200 hours, allow the fluid to return to ambient temperature (nominally 25° C.), then dry the coupons and wash them with acetone. Visually inspect each coupon and rate it on a scale of 1 to 5, where a rating of 5 indicates no staining or corrosion, a rating of 4 indicates surface corrosion in excess of 0 percent (%) up to 10%, a rating of 3 indicates surface corrosion of at least 10% up to 50%, a rating of 2 indicates surface corrosion of at least 50% up to 80% and a rating of 1 indicates severe staining or corrosion as in more than 80% up to 100%. Assess both the front side and the back side of each coupon is assessed and report measurements. A score of 4 or more for all metals tested, except for aluminium where a score of 3 may be used, constitutes an acceptable corrosion performance. A lower acceptable score for aluminium relates to its nature as an amphoteric metal that is susceptible to staining in water-based lubricants with a pH in excess of 9. As most hydraulic equipment contains limited amounts of aluminium, a score of 3 or more is acceptable as scores for other metals that appear in greater abundance in hydraulic equipment merit greater attention.

Wear Testing

Use a Vickers Vane V-104C pump and a variation of ASTM D-7043 to evaluate potential lubrication properties of hydraulic fluids. For the variation, use a one gallon reservoir, rather than a five gallon reservoir according to ASTM D-7043, and implement a comprehensive cleaning procedure subsequent to each test run to effectively eliminate contamination from one test run to a succeeding test run. In the comprehensive cleaning procedure, strip the machine, clean the stripped parts and rebuild the machine, replacing worn parts as needed. Conduct wear testing at a pressure of 2000 psig (14 MPa), a rotary speed of 1200 revolutions per minute (rpm), a hulk fluid temperature of 65° C. and a test duration of 100 hours. Determine weight loss of pump vanes and ring and report combined weights as total weight loss during testing for each test run.

Reserve Alkalinity (RA) Testing

Dilute approximately 10 ml (weighed to the nearest 0.1 ml) of a sample fluid in 50 ml of deionized water to yield a dilute fluid solution. Use an autotitrator to potentiometrically titrate the dilute fluid solution with standardized 0.100 Normal (0.100 N) aqueous hydrochloric acid (HCl). Calculate RA using the following equation:

$$RA = \frac{mL \times \rho \frac{g}{mL} \times \frac{N \frac{\text{mol}}{\text{L}}}{0.100 \frac{\text{mol}}{\text{L}}} \times 100 \text{ mL}}{g}$$

$$RA = \frac{1000 \times mL \times \rho \times N}{g}$$

where:

RA=reserve alkalinity of the sample mL=the volume of 0.100 N HCl required to neutralize the sample to a pH of 5.5

ρ=the density of the sample at 25° C.

N=the concentration of the aqueous hydrochloric acid titrant g=the weight of sample titrated pH Testing Perform pH testing in accord with American Society for Testing and Materials (ASTM) E70.

EXAMPLES

The following examples illustrate, but do not limit, the present invention. All parts and percentages are based upon weight, unless otherwise stated. All temperatures are in ° C. Examples (Ex) of the present invention are designated by Arabic numerals and Comparative Examples (Comp Ex or CEx) are designated by capital alphabetic letters. Unless otherwise stated herein, "room temperature" and "ambient temperature" are nominally 25° C.

Ex 1-2 and Comp Ex A-M

Prepare a plurality of glycol/water solutions having compositions as shown in Table 1 below using the following procedure: to a 1000 ml beaker, add water, then diethylene glycol, followed by amine and alkanolamine, either separately together or in any order. Stir contents of the beaker at ambient temperature (nominally 25° C.) until the contents have a visual appearance of a clear, homogeneous solution. Add decanoic acid with continued stirring at ambient temperature until the contents regain the visual appearance. Add tolyltriazole with continued stirring until the tolyltriazole appears to be fully dissolved. While ambient temperature typically suffices, mild heating (e.g. up to 50° C.) may enhance dissolution of the tolyltriazole. Finally, add polyglycol (polyalkylene glycol) with continued stirring at ambient temperature until contents of the beaker regain the appearance of a clear, homogeneous solution.

In Tables 1-4 below, AMP=2-amino-2-methyl-1-propanol (commercially available from Angus Chemical under the trade designation "AMP-95"); MIPA=mono-isopropanolamine; TEA=triethanolamine; DMEA=N,N-dimethylethanolamine; DEEA N,N-diethylethanolamine; DEG=diethylene glycol; and PAG=polyalkylene glycol (also known as "d-PAG-A", a developmental glycerol initiated polyalkylene glycol having an ethylene oxide content of 75 percent by weight (wt %) and a propylene oxide content of 25 wt %, in each case based upon total PAG weight, a molecular weight of approximately 25,300, a hydroxyl group (OH) percentage of 0.2, and a viscosity, at 210 degrees Fahrenheit ((° F.) (93.3 degrees centigrade (° C.)), of 11800 centistokes (cSt) (0.012 square meters per second ($m^2/s$)).

Subject the resulting solutions to RA determination (ml), solution pH determination, solution corrosion testing and vapor phase corrosion testing using procedures as detailed above. Report corrosion testing using the following code: 5=no visually detectable corrosion; 4=from greater than 0 percent observed surface corrosion to less than 10 percent observed surface corrosion; 3=from 10 percent observed surface corrosion to less than 50 percent observed surface corrosion; 2=from 50 percent observed surface corrosion to less than 80 percent observed surface corrosion; and 1=from 80 percent observed surface corrosion to 100 percent observed surface corrosion.

Comp Ex A contains no alkanolamine, a component that functions as a vapor phase corrosion inhibitor. The remaining Ex and Comp Ex in Table 1 contain an amount of at least one of, TEA, DMEA and DEEA as a vapor phase corrosion inhibitor.

TABLE 1

Glycol/Water Solution Composition and Corrosion, pH and Reserve Alkalinity Test Results

| | Component/Ex or Comp Ex | | | | | | | | | | | | | | |
|---|---|---|---|---|---|---|---|---|---|---|---|---|---|---|---|
| | CEx A | CEx B % | CEx C % | CEx D % | CEx E % | Ex 1 % | CEx F % | Ex 2 % | CEx G % | CEx H % | CEx I % | CEx J % | CEx K % | CEx L % | CEx M % |
| Water | 40 | 40 | 40 | 40 | 40 | 40 | 40 | 40 | 40 | 40 | 40 | 40 | 40 | 40 | 40 |
| DEG | 46.0 | 44.0 | 44.0 | 44.5 | 44.5 | 44.75 | 44.75 | 45 | 45 | 45.2 | 45.2 | 45.05 | 45.05 | 44.85 | 44.5 |
| PAG | 11.75 | 11.75 | 11.75 | 11.75 | 11.75 | 11.75 | 11.75 | 11.75 | 11.75 | 11.75 | 11.75 | 11.75 | 11.75 | 11.75 | 11.75 |
| Decanoic acid | 1.4 | 1.4 | 1.4 | 1.4 | 1.4 | 1.4 | 1.4 | 1.4 | 1.4 | 1.4 | 1.4 | 1.4 | 1.4 | 1.4 | 1.4 |
| Tolyl-triazole | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 |
| AMP | 0.75 | 0.75 | 0.75 | 0.75 | 0.75 | 0.75 | 0.75 | 0.75 | 0.75 | | | | | 0.4 | 0.25 |
| MIPA | | | | | | | | | | 0.65 | 0.65 | 0.6 | 0.6 | | |
| TEA | | | | | | | | | | | | | | 0.5 | 1.0 |
| DMEA | | 2.0 | | 1.5 | | 1.25 | | 1.0 | | | 1.0 | 1.2 | | | 0.25 |
| DEEA | | | 2.0 | | 1.5 | | 1.25 | | 1.0 | 1.0 | | | 1.2 | 1.0 | 0.75 |
| RA (ml) | 62 | 254 | 248 | 203 | 176 | 180 | 166 | 149 | 112 | 150 | 180 | 196 | 167 | n/d | n/d |
| pH | 7.4 | 9.8 | 9.8 | 9.7 | 9.9 | 9.6 | 9.6 | 9.2 | 9.7 | 9.85 | 9.76 | 9.82 | 9.87 | n/d | n/d |

TABLE 1-continued

Glycol/Water Solution Composition and Corrosion, pH and Reserve Alkalinity Test Results Table 1 Solution Corrosion Performance

| | CEx A | CEx B | CEx C | CEx D | CEx E | Ex 1 | CEx F | Ex 2 |
|---|---|---|---|---|---|---|---|---|
| Steel | 5, 5 | 5, 5 | 5, 4.5 | 5, 5 | 5, 5 | 5, 5 | 5, 5 | 5.4, 5 |
| Cast Iron | 4, 4 | 4.5, 5 | 4.5, 5 | 4.5, 5 | 4.5, 5 | 4.5, 5 | 4.5, 5 | 4.5, 5 |
| Aluminum | 4, 4 | 1, 1 | 2.5, 2.5 | 2.5, 2.5 | 4, 3.5 | 3.5, 4 | 3, 3.5 | 3.5, 4 |
| Copper | 4, 4 | 5, 5 | 5, 4.5 | 5, 4.5 | 4.5, 4.5 | 5, 5 | 4.5, 4.5 | 4, 5 |
| Brass | 4, 4 | 4, 3 | 4, 4 | 4, 3 | 3, 3 | 4, 4 | 3, 2 | 4, 4.5 |

Table 1 Solution Corrosion Performance

| | CEx G | CEx H | CEx I | CEx J | CEx K | CEx L | CEx M |
|---|---|---|---|---|---|---|---|
| Steel | 5, 5 | 4.5, 4.5 | 4.5, 4.5 | 4, 4.5 | 4, 4.5 | 4.5, 4.5 | 5, 5 |
| Cast Iron | 4.5, 4.5 | 4, 4 | 4, 4 | 4, 3.5 | 2, 2 | 3, 3 | 2.2, 3 |
| Aluminum | 4, 4 | 2.5, 3 | 3, 3 | 2, 2 | 2, 2 | 3, 3 | 3, 3 |
| Copper | 4, 4.5 | 5, 5 | 5, 5 | 4.5, 4.5 | 4, 4 | 5, 5 | 5, 5 |
| Brass | 3.5, 3.5 | 2, 2 | 2, 2 | 1.5, 2 | 1.5, 3 | 4, 4 | 4.5, 4.5 |

Table 1 Vapour Phase Corrosion Performance

| | CEx A | CEx B | CEx C | CEx D | CEx E | Ex 1 | CEx F | Ex 2 | CEx G | CEx H | CEx I | CEx J | CEx K | CEx L | CEx M |
|---|---|---|---|---|---|---|---|---|---|---|---|---|---|---|---|
| Steel | 4, 3 | 5, 5 | 5, 5 | 5, 5 | 5, 5 | 5, 5 | 5, 5 | 5, 4.5 | 5, 4.5 | 4, 4 | 5, 4.5 | 4.5, 4.5 | 4, 4 | 5, 4 | 5, 4.5 |
| Cast Iron | 1, 1 | 4, 4 | 5, 4 | 4, 4.5 | 4, 4 | 4, 4.5 | 4.5, 5 | 4.5, 4.5 | 5, 4.5 | 3.5, 3.5 | 4, 4 | 4, 4 | 4.5, 4 | 3, 3 | 2.5, 3 |

The data presented in Table 1 above, suggest that one avoid using a combination of MIPA, as a primary amine, with either DMEA or DEEA as an alkanolamine. See Comp Ex J and Comp Ex K, which show poor compatibility with aluminium and Comp Ex H through Comp Ex K which show poor compatibility with brass. The data also suggest that TEA fails to provide adequate vapour phase corrosion protection for cast iron (Comp Ex L and Comp Ex M). The data further suggest that certain fluids (Ex 1 and Ex 2), which contain AMP-95, in combination with DMEA, have desirable corrosion performance test results as well as suitable reserve alkalinities and pH values.

Longer term testing than that summarized in Table 1 above suggests that, by maintaining RA within a range of from 150 ml to 200 ml, one realizes better pump performance than that provided by water/glycol fluids that contain the same components, but have a reserve alkalinity of less than 150 ml or greater than 200 ml. Values less than 150 ml trend toward rapid depletion of the reserve amine levels and in turn, ferrous corrosion problems and higher pump wear rates, whereas values in excess of 200 ml provide poor aluminium compatibility.

Ex 3-8 and Comp Ex N-T

Replicate Ex 1 above with formulation changes as shown in Table 2 below. The formulations contain fixed amounts of water, PAG (d-PAG-A), decanoic acid and tolyltriazole, and varying amounts of AMP-95, DEEA and/or DMEA, and DEG as shown in Table 2. Table 2 also contains corrosion performance, pH and reserve alkalinity test data.

TABLE 2

Glycol/Water Solution Composition and Corrosion, pH and Reserve Alkalinity Test Results

| | Component/Ex or CEx | | | | | | | | | | | | |
|---|---|---|---|---|---|---|---|---|---|---|---|---|---|
| | CEx N | CEx O | CEx P | CEx Q | Ex 3 | CEx R | Ex 4 | CEx S | CEx T | Ex 5 | Ex 6 | Ex 7 | Ex 8 |
| Water | 40 | 40 | 40 | 40 | 40 | 40 | 40 | 40 | 40 | 40 | 40 | 40 | 40 |
| DEG | 44.8 | 44.8 | 44.85 | 45.05 | 45.25 | 45.25 | 45.05 | 45.05 | 45.25 | 44.95 | 45.05 | 45.1 | 45.05 |
| PAG | 11.75 | 11.75 | 11.75 | 11.75 | 11.75 | 11.75 | 11.75 | 11.75 | 11.75 | 11.75 | 11.75 | 11.75 | 11.75 |
| Decanoic acid | 1.4 | 1.4 | 1.4 | 1.4 | 1.4 | 1.4 | 1.4 | 1.4 | 1.4 | 1.4 | 1.4 | 1.4 | 1.4 |
| Tolyltriazole | 0.1 | 0.1 | 0.1 | 0.1 | 0.1 | 0.1 | 0.1 | 0.1 | 0.1 | 0.1 | 0.1 | 0.1 | 0.1 |
| AMP | 0.6 | 0.6 | 0.65 | 0.65 | 0.5 | 0.5 | 0.5 | 0.5 | 0.5 | 0.6 | 0.7 | 0.65 | 0.6 |
| DMEA | 1.35 | | 1.25 | | 1 | | 1.2 | | 0.5 | 0.6 | 0.5 | 0.5 | 0.55 |
| DEEA | | 1.35 | | 1.25 | | 1 | | 1.2 | 0.5 | 0.6 | 0.5 | 0.5 | 0.55 |
| RA (ml) | 197 | 193 | 193 | 195 | 146 | 119 | 172 | 130 | 139 | 174 | 179 | 177 | 177 |
| pH | 9.5 | 9.5 | 9.5 | 9.5 | 9.2 | 9.5 | 9.3 | 9.6 | 9.3 | 9.4 | 9.5 | 9.4 | 9.5 |

TABLE 2-continued

Glycol/Water Solution Composition and Corrosion, pH and Reserve Alkalinity Test Results Solution Corrosion Performance

| | Ex or CEx | | | | | | | | | | | | |
|---|---|---|---|---|---|---|---|---|---|---|---|---|---|
| | CEx N | CEx O | CEx P | CEx Q | Ex 3 | CEx R | Ex 4 | CEx S | CEx T | Ex 5 | Ex 6 | Ex 7 | Ex 8 |
| Steel | 4.5, 4 | 4, 4 | 5, 4.5 | 4, 4 | 5, 5 | 5, 5 | 5, 5 | 5, 5 | 5, 5 | 4.5, 4.5 | 5, 5 | 5, 5 | 5, 5 |
| Cast Iron | 4.5, 4 | 3, 3 | 3.5, 4 | 4, 4 | 4.5, 4.5 | 5, 4.5 | 4.5, 4.5 | 5, 5 | 5, 5 | 4, 4 | 5, 4 | 5, 5 | 5, 5 |
| Aluminium | 2.5, 3 | 2, 2 | 3.5, 3.5 | 3, 3 | 3, 4 | 4.5, 4.5 | 3.5, 3.5 | 4.5, 4 | 4, 3.5 | 4, 3.5 | 3, 3 | 3, 3.5 | 4.5, 4.5 |
| Copper | 4.5, 4.5 | 4, 4.5 | 4, 4.5 | 4.5, 4.5 | 5, 5 | 5, 5 | 5, 5 | 5, 5 | 5, 5 | 4.5, 4 | 4.5, 4.5 | 5, 5 | 5, 5 |
| Brass | 4.5, 4 | 4, 4.5 | 4, 5 | 4.5, 4.5 | 5, 4.5 | 4.5, 4.5 | 4, 4 | 4, 5 | 4, 4 | 5, 4 | 4.5, 4.5 | 4, 4 | 4.5, 4.5 |

Vapour Phase Corrosion Performance

| | Ex or CEx | | | | | | | | | | | | |
|---|---|---|---|---|---|---|---|---|---|---|---|---|---|
| | CEx N | CEx O | CEx P | CEx Q | Ex 3 | CEx R | Ex 4 | CEx S | CEx T | Ex 5 | Ex 6 | Ex 7 | Ex 8 |
| Steel | 4.5, 5 | 4.5, 4.5 | 5, 4.5 | 4.5, 4.5 | 5, 5 | 5, 4.5 | 5, 5 | 5, 5 | 5, 5 | 4.5, 4 | 5, 5 | 5, 5 | 5, 5 |
| Cast Iron | 4, 4 | 3, 3.5 | 4.5, 4 | 3.5, 3 | 4.5, 5 | 5, 4.5 | 5, 4.5 | 4, 4 | 4.5, 4.5 | 4, 4 | 4.5, 5 | 5, 5 | 4.5, 4.5 |

The data presented in Table 2 show that certain fluids (Ex 3-8), which contain AMP, in combination with either or both of DEEA or DMEA, have desirable corrosion performance test results as well as suitable reserve alkalinities and pH values. The fluids of Ex 3-8 all have a DEEA and/or DMEA content less than 1.25 wt %, based upon total fluid weight. The data suggest that a single formulation change, as shown in Ex 3 (contains DMEA) and Comp Ex R (contains DEEA) yields a shift in both fluid pH and reserve alkalinity in conjunction with minor changes in corrosion performance. Comp Ex N and Comp Ex O, which have respective levels of DMEA and DEEA greater than any other fluid shown in Table 2, evidence unacceptable aluminium compatibility whereas Comp Ex P and Comp Ex Q, with slightly lower (1.25 wt % versus 1.35 wt %) DMEA or DEEA level, have comparable corrosion performance for all metals except aluminium in conjunction with improved corrosion performance relative to aluminium. Ex 3-8 all show excellent multi-metal corrosion performance, both solution corrosion performance and vapor phase corrosion performance, relative to Comp Ex N-O.

Ex 9-14 and CEx U-V

Replicate Ex 5 with changes to prepare a plurality of water/glycol fluid compositions with varying water and DEG contents as shown in Table 3 below. Reduce the amount of tolyltriazole from 0.1 wt % to 0.06 wt % and add 0.04 wt % of an ethylene oxide/propylene oxide (EO/PO) copolymer having an ethylene oxide content of 28 wt %, based upon copolymer weight (UCON™ Lub 1281, commercially available from The Dow Chemical Company) to counter the reduction in tolyltriazole amount, each wt % being based upon total water/glycol fluid composition weight.

TABLE 3

| | Ex 9 | Ex 10 | Ex 11 | Ex 12 | Ex 13 | Ex 14 | CEx U | CEx V |
|---|---|---|---|---|---|---|---|---|
| Water | 40 | 44 | 46 | 48 | 50 | 52 | 54 | 56 |
| DEG | 44.95 | 40.95 | 38.95 | 36.95 | 34.95 | 32.95 | 30.95 | 28.95 |
| PAG | 11.75 | 11.75 | 11.75 | 11.75 | 11.75 | 11.75 | 11.75 | 11.75 |
| AMP | 0.6 | 0.6 | 0.6 | 0.6 | 0.6 | 0.6 | 0.6 | 0.6 |
| DEEA | 0.6 | 0.6 | 0.6 | 0.6 | 0.6 | 0.6 | 0.6 | 0.6 |
| DMEA | 0.6 | 0.6 | 0.6 | 0.6 | 0.6 | 0.6 | 0.6 | 0.6 |
| EO/PO copolymer | 0.04 | 0.04 | 0.04 | 0.04 | 0.04 | 0.04 | 0.04 | 0.04 |
| Decanoic Acid | 1.4 | 1.4 | 1.4 | 1.4 | 1.4 | 1.4 | 1.4 | 1.4 |
| Tolyl-triazole | 0.06 | 0.06 | 0.06 | 0.06 | 0.06 | 0.06 | 0.06 | 0.06 |

Subject those formulations that have water contents of 48 wt %, 50 wt %, 52 wt % and 54 wt %, to wear testing to determine total ring and vane wear, pH measurement, before and after wear testing, alkalinity (ml) before and after wear testing, and kinematic viscosity at 40° C. (KV40), before and after wear testing. Summarize test results in Table 4 below.

TABLE 4

| Ex/CEx | % Water | Initial KV40 (cSt/m$^2$/s) | Final KV40 (cSt or $10^{-6}$ m$^2$/s) | % Viscosity change | Initial RA (ml) | Final RA, (ml) | Initial pH | Final pH | Total ring and vane wear (mg) |
|---|---|---|---|---|---|---|---|---|---|
| Ex 11 | 46 | 45.4/ | 37.9 | 16.5 | 174 | 159 | 9.6 | 9.4 | 13.9 |
| Ex 12 | 48 | 44.7/ | 40.8 | 8.7 | 175 | 180 | 9.8 | 9.7 | 14.5 |
| Ex 13 | 50 | 44.1/ | 38.8 | 12 | 154 | 149 | 9.7 | 9.6 | 33.9 |
| Ex 14 | 52 | 47.2/ | 41.3 | 12.5 | 179 | 158 | 9.8 | 9.7 | 16.4 |
| CEx U | 54 | 46.6/ | 41.5 | 10.9 | 172 | 159 | 9.8 | 9.5 | 1081 |

Ex 15-22 and CEx W-AA

Replicate Ex 9-14 and CEx U-V with changes to replace d-PAG-A with d-PAG-B (Table 5 hydraulic performance data), d-PAG-C (Table 6 hydraulic performance data) and PAG-D (Table 7 hydraulic performance data). "d-PAG-B is a trimethylolpropane-based, developmental PAG with the same wt % of ethylene oxide and propylene oxide as d-PAG-A, but molecular weight of approximately 42630 and a viscosity at 210° F. (99° C.) of 11525 cSt (0.012 $m^2/s$). "d-PAG-C is a pentaerythritol-based, developmental PAG with the same wt % of ethylene oxide and propylene oxide as d-PAG-A, but a molecular weight of approximately 46625 and a viscosity at 210° F. (99° C.) of 12025 cSt (0.012 $m^2/s$). PAG-D is a PAG (commercially available from The Dow Chemical Company under the trade designation UCON™ lubricant 75H-380,000) with the same wt % of ethylene oxide and propylene oxide as d-PAG-A, but a molecular weight of approximately 25,000 and a viscosity at 210° F. (99° C.) of approximately 11800 cSt (0.012 $m^2/s$).

TABLE 5

| Ex/CEx No | % Water | Initial KV40 (cSt or $10^{-6}$ $m^2/s$) | Final KV40 (cSt or $10^{-6}$ $m^2/s$) | % Viscosity change | Initial RA (ml) | Final RA, (ml) | Initial pH | Final pH | Total ring and vane wear (mg) |
|---|---|---|---|---|---|---|---|---|---|
| Ex 15 | 46 | 45.2 | 38.5 | 14.8 | 176 | 172 | 9.6 | 9.5 | 12.9 |
| Ex 16 | 48 | 46.8 | 38.5 | 17.7 | 176 | 167 | 9.6 | 9.5 | 13.2 |
| Ex 17 | 50 | 46.5 | 39 | 16.1 | 175 | 164 | 9 9 | 9.5 | 12.7 |
| Ex 18 | 52 | 47.6 | 40 | 16 | 176 | 167 | 9.5 | 9.5 | 17.3 |
| Ex 19 | 54 | 45.5 | 41.2 | 9.5 | 176 | 172 | 9.6 | 9.5 | 31.6 |
| CEx W | 56 | 47.2 | 36.3 | 23.1 | 169 | 172 | 9.7 | 9.6 | 4057 |

TABLE 6

| Ex/CEx No | % Water | Initial KV40 (cSt or $10^{-6}$ $m^2/s$) | Final KV40 (cSt or $10^{-6}$ $m^2/s$) | % Viscosity change | Initial RA (ml) | Final RA, (ml) | Initial pH | Final pH | Total ring and vane wear (mg) |
|---|---|---|---|---|---|---|---|---|---|
| Ex 20 | 46 | 46.4 | 38.8 | 16.4 | 176 | 169.5 | 9.6 | 9.5 | 15.1 |
| Ex 21 | 48 | 47 | 38.1 | 18.9 | 177 | 167 | 9.7 | 9.5 | 13 |
| Ex 22 | 50 | 46 | 36.6 | 20.4 | 174 | 167 | 9.7 | 9.5 | 16.3 |
| CEx X | 52 | 43 | 37 | 14 | 178 | 174 | 9.7 | 9.5 | 324 |
| CEx Y | 52 | 46.6 | 39.2 | 15.9 | 167 | 167 | 9.6 | 9.5 | 2936 |
| CEx Z | 52 | 46 | 39.2 | 14.8 | 173 | 170 | 9.6 | 9.4 | 768 |
| CEx AA | 54 | 46 | 37.2 | 19.1 | 173 | 169 | 9.6 | 9.5 | 456 |

TABLE 7

| Ex/CEx No | % Water | Initial KV40 (cSt or $10^{-6}$ $m^2/s$) | Final KV40 (cSt or $10^{-6}$ $m^2/s$) | % Viscosity change | Initial RA (ml) | Final RA, (ml) | Initial pH | Final pH | Total ring and vane wear (mg) |
|---|---|---|---|---|---|---|---|---|---|
| Ex 23 | 48 | 47.7 | 42.9 | 10.1 | 156 | 154 | 9.6 | 9.4 | 13.7 |
| Ex 24 | 50 | 45.5 | 39.4 | 13.4 | 176 | 170 | 9.8 | 9.6 | 12.6 |
| Ex 25 | 51 | 44.4 | 40.3 | 9.2 | 177 | 176 | 9.6 | 9.4 | 32.7 |
| CEx AB | 52 | 44.8 | 39.9 | 10.9 | 170 | 153 | 9.6 | 9.5 | 947.2 |
| CEx AC | 54 | 45.4 | 41.1 | 9.5 | 180 | 178 | 9.9 | 9.6 | 1775. |

The data presented in Tables 4-7 demonstrate very desirable (less than 100 mg, preferably less than 50 mg) total ring and wear performance for water-glycol hydraulic fluids representative of the present invention based upon a combination of amines and alkanolamines with a variety of thickeners at various water contents. Ex 11-25 all show the very desirable total ring and wear performance at water levels in excess of 44 wt %, with Ex 11, Ex 15 and Ex 20 at 46 wt %, Ex 13, Ex 17, Ex 22 and Ex 24 at 50 wt %, Ex 25 at 51 wt %, Ex 14 and Ex 18 at 52 wt % and Ex 19 at 54 wt %. Conventional water-glycol hydraulic fluids that yield a less than 100 mg total ring and wear performance contain water at no more than 40 wt %. Skilled artisans recognize that results such as those presented for CEx X-CEx Z, all of which have the same composition, are typical as one exceeds a total ring and wear performance of 250 mg. One possible explanation for such erratic results is that particulate debris generated during wear testing further accelerates wear.

Ex 26-34 and CEx AD-AG

Replicate Ex 15-25 and CEx W-AC with changes to substitute a higher viscosity developmental PAG, either d-PAG-E (glycerol-based), d-PAG-F (trimethylolpropane-based) or PAG-G, for d-PAG-A and increase the amount of PAG, whether d-PAG-E, d-PAG-F or PAG-G, from 11.75 wt % to 16.6 wt %, with a complementary decrease in amount of DEG relative to formulations having the same water content as those shown in Table 3 above. For example, a formulation that has a water content of 50 wt % has a d-PAG-A content of 11.75 wt % and a DEG content of 34.95 wt % whereas a formulation with the same water content has a d-PAG-D content of 16.5 wt % and a DEG content of 30.2 wt %. In other words, as d-PAG content increases by a set amount, DEG content decreases by the set amount. d-PAG-E and d-PAG-F both have the same wt % of ethylene oxide and propylene oxide, but d-PAG-D has a viscosity at 104° F. (40° C.) of 15900 cSt (0.016 $m^2/s$) and a molecular weight of approximately 22,000, and d-PAG-E has a viscosity at 104° F. (40° C.) of approximately 19180 cSt (0.019 $m^2/s$) and a molecular weight of approximately 22,000. PAG-G is a PAG (commercially available from The Dow Chemical Company under the trade designation UCON™ lubricant 75H-90,000) with the same wt % of ethylene oxide and propylene oxide as d-PAG-A, but a molecular weight of approximately 12,000 and a viscosity at 210° F. (99° C.) of 2500 cSt (0.002 $m^2/s$). Tables 8 through 10 below summarize test data for formulations that contain, respectively, d-PAG-E, d-PAG-F and PAG-G, with water contents as shown. The test data presented in Tables 8 through 10 include initial viscosity measurements as well as viscosity measurements after elapsed times of 24 hours, 48 hours, 72 hours and 100 hours.

TABLE 8

Hydraulic Pump Performance (d-PAG-E)

| Ex/CEx | Water Content | KV40, cSt (or $10^{-6}$ $m^2/s$) at time in hours | | | | | RA, (ml) | | pH | | Total ring & vane wear |
|---|---|---|---|---|---|---|---|---|---|---|---|
| No | (wt %) | 0 | 24 | 48 | 72 | 100 | Initial | Final | Initial | Final | (mg) |
| Ex 26 | 54 | 44.2 | 43.6 | 42.9 | 42.5 | 42.3 | 168 | 162 | 9.8 | 9.6 | 53 |
| Ex 27 | 50 | 45.2 | 44.6 | 43.8 | 43.6 | 43.4 | 175 | 168 | 9.8 | 9.7 | 16.4 |
| Ex 28 | 44 | 46.2 | 45.5 | 45 | 44.8 | 44.3 | 181 | 173 | 9.6 | 9.5 | 8.6 |
| Ex 29 | 40 | 44.9 | 43.6 | 43.1 | 43.1 | 42.9 | 169 | 168 | 9.6 | 9.5 | 8.6 |

TABLE 9

Hydraulic Pump Performance (d-PAG-F)

| Ex/CEx | Water Content | KV40, cSt (or $10^{-6}$ $m^2/s$) at time in hours | | | | | RA, (ml) | | pH | | Total ring & vane wear |
|---|---|---|---|---|---|---|---|---|---|---|---|
| No | (wt %) | 0 | 24 | 48 | 72 | 100 | Initial | Final | Initial | Final | (mg) |
| CEx AD | 54 | 46 | 45.6 | 45.9 | n/d | 44.3 | 169.2 | 173 | 9.6 | 9.5 | 8164 |
| CEx AE | 54 | 46.4 | n/d | n/d | n/d | 43.1 | 162 | 175 | 9.7 | 9.6 | 2430 |
| CEx AF | 50 | 47.3 | 46.8 | 45.9 | 46.5 | 47.1 | 162 | 161 | 9.8 | 9.7 | 3046 |
| Ex 30 | 44 | 45.9 | n/d | 44.2 | 43.5 | 43.3 | 160 | 155 | 9.6 | 9.6 | 22.1 |
| Ex 31 | 40 | 43.3 | 42.4 | 42.4 | 42 | 41.5 | 163 | 165 | 9.6 | 9.6 | 9.4 |

TABLE 10

Hydraulic Pump Performance (PAG-G)

| Ex/CEx | Water Content | KV40, cSt (or $10^{-6}$ $m^2/s$) at time in hours | | | | | RA, (ml) | | pH | | Total ring & vane wear |
|---|---|---|---|---|---|---|---|---|---|---|---|
| No | (wt %) | 0 | 24 | 48 | 72 | 100 | Initial | Final | Initial | Final | (mg) |
| CEx AG | 54 | 44.2 | 43.5 | 43.1 | 42.3 | 41.8 | 163 | 163 | 9.8 | 9.6 | 191.2 |
| Ex 32 | 50 | 45.2 | 44.6 | 44.1 | 43.9 | 43.8 | 166.5 | 162.4 | 9.6 | 9.5 | 20.9 |
| Ex 33 | 44 | 46.7 | 45.4 | 45.2 | 44.6 | 45.2 | 178 | 172 | 9.7 | 9.6 | 10.6 |
| Ex 34 | 40 | 48.9 | 47.2 | 47 | 46.8 | 46.4 | 174.9 | 166.8 | 9.6 | 9.5 | 5.2 |

The data presented in Tables 8 through 10 show similar trends to that shown in Tables 4-7. The data also show that compositions of the present invention have a greater range of potential water contents that deliver very desirable total ring and vane wear performance with a glycerol-based PAG viscosity modifier (d-PAG-D) than with a trimethylolpropane-based PAG viscosity modifier (d-PAG-E). Even with d-PAG-E, total ring and wear vane performance of less than 100 mg occurs at water contents of 40 wt % and 44 wt %. A water content in excess of 44 wt %, but less than 50 wt % for d-PAG-E-containing formulations, should also produce a total ring and vane wear performance of less than 100 mg.

Morpholine-free water-hydraulic liquid compositions within the scope of appended claims, but not expressly illustrated in this example section, should produce comparable results, some with relatively narrow water content range, as in Table 9, some with an intermediate water content range, as in Table 10, and some with a broader water content range, as in Table 8.

The invention claimed is:

1. A morpholine-free water-hydraulic liquid composition, consisting of:

water, a glycol, a polyglycol, decanoic acid, a combination of amines and alkanolamines, and optionally a primary alkanolamine selected from the group consisting of monoethanolamine, 2-amino-1,3-propanediol, 2-amino-2-methyl-1,3-propanediol, 2-amino-2-ethyl-1,3-propanediol, tris(hydroxymethyl)-aminomethane and 2-amino-1-butanol, wherein the combination of amines and alkanolamines comprises 2-amino-2-methyl-1-propanol, N,N-dimethylethanolamine, and N,N-diethylethanolamine, wherein the composition has a pH equal to or greater than 9, and wherein the composition yields a total weight loss of ring and vanes in a modified Vickers Vane V104C pump test of less than 20 milligrams per 100 hours as measured in accord with ASTM D-7043 modified by using a one gallon reservoir, rather than a five gallon reservoir according to ASTM D-7043, stripping the pump subsequent to each test run and cleaning the stripped parts and rebuilding the pump, and conducting wear testing at a pressure of 2000 psig (14 MPa), a rotary speed of 1200 revolutions per minute (rpm), a bulk fluid temperature of 65° C. and a test duration of 100 hours, and wherein the composition has an initial reserve alkalinity from 145 milliliters to 200 milliliters, and wherein the polyglycol is a random copolymer of ethylene oxide and propylene oxide with an ethylene oxide content within a range of from 50 weight-percent to 90 weight-percent and a complementary content of propylene oxide within a range of from 10 weight-percent to 50 weight-percent in each case based upon total weight of ethylene oxide and propylene oxide, with complimentary amount of propylene oxide, when added to amount of ethylene oxide, equaling 100 percent by weight and wherein the composition has a water content from 30 to 54 percent by weight based upon total composition weight and wherein the composition has a polymer content from 10 to 20 percent by weight based upon total composition weight; and wherein the composition has from 0.5 to 1 percent by weight of 2-amino-2-methyl-1-propanol, from 0.1 to 2 percent by weight combined N,N-dimethylethanolamine, and N,N-diethylethanolamine; and from 0.5 to 2.5 percent by weight decanoic acid, all based upon total composition weight.

2. The composition of claim 1 wherein the decanoic acid is present in an amount sufficient to form an equilibrium acid-base salt complex with at least one amine.

3. The composition of claim 1, wherein the primary alkanolamine is at least one of monoethanolamine and 2-amino-1-butanol.

4. The composition of claim 1 wherein the glycol is selected from the group consisting of ethylene glycol, propylene glycol, diethylene glycol, triethylene glycol, dipropylene glycol, tripropylene glycol, a "bottom glycols" fraction produced during manufacture of diethylene glycol, and butylene glycol, and the alkylene glycol is present in an amount within a range of from 30 percent by weight to 50 percent by weight, based upon total weight composition.

5. The composition of claim 1 wherein the polyglycol is prepared from a random mixed feed of ethylene oxide and propylene oxide onto an initiator selected from glycerol, pentaerythritol, trimethylolpropane or diethylene glycol.

* * * * *